US007583247B2

(12) United States Patent
Park et al.

(10) Patent No.: US 7,583,247 B2
(45) Date of Patent: Sep. 1, 2009

(54) GATE DRIVER FOR A DISPLAY DEVICE AND METHOD OF DRIVING THE SAME

(75) Inventors: Kwang Soon Park, Daegoo (KR); Soo Young Yoon, Gyeonggi-do (KR); Min Doo Chun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 701 days.

(21) Appl. No.: 11/317,812

(22) Filed: Dec. 27, 2005

(65) Prior Publication Data

US 2006/0227094 A1 Oct. 12, 2006

(30) Foreign Application Priority Data

Apr. 11, 2005 (KR) ..... 10-2005-0029840

(51) Int. Cl.
*G09G 3/36* (2006.01)

(52) U.S. Cl. ..... 345/100; 345/87; 345/99; 345/204; 345/210; 345/211; 377/54; 377/64; 377/69

(58) Field of Classification Search ..... 345/87, 345/99, 100, 204, 210, 211; 377/64, 69, 377/54

See application file for complete search history.

(56) References Cited

U.S. PATENT DOCUMENTS

| | | | | |
|---|---|---|---|---|
| 5,040,070 | A * | 8/1991 | Higashitsutsumi et al. | 348/298 |
| 5,758,135 | A * | 5/1998 | Tucker et al. | 713/501 |
| 5,856,686 | A * | 1/1999 | Watanabe et al. | 257/291 |
| 6,333,895 | B1 * | 12/2001 | Hamamoto et al. | 365/233.1 |
| 7,420,536 | B2 * | 9/2008 | Jang et al. | 345/100 |
| 2004/0150610 | A1 * | 8/2004 | Zebedee et al. | 345/100 |
| 2005/0018807 | A1 * | 1/2005 | Han et al. | 377/69 |
| 2006/0082224 | A1 * | 4/2006 | Marshall et al. | 307/125 |

* cited by examiner

*Primary Examiner*—Bipin Shalwala
*Assistant Examiner*—Vince E Kovalick
(74) *Attorney, Agent, or Firm*—Morgan Lewis & Bockius LLP

(57) ABSTRACT

A gate driver for a display device includes a plurality of shift registers to sequentially generate output signals during a frame period in response to multi-phase clocks; and a dummy clock provided to the plurality of shift registers during a vertical blank time to reduce a stress voltage in the shift registers, wherein an output of each of the shift registers is reset to a low state power supply voltage by an output signal of the next shift register.

17 Claims, 8 Drawing Sheets

GATE DRIVER FOR A DISPLAY DEVICE AND METHOD OF DRIVING THE SAME

This application claims the benefit of the Korean Patent Application No. 2005-029840 filed in Korea on Apr. 11, 2005, which is hereby incorporated by reference.

BACKGROUND OF THE INVENTION

1. Field of the Invention

The present invention relates to a gate driver for a display device, and more particularly, to a reliable gate driver and a method of driving the gate driver.

2. Background of the Related Art

Display devices having a screen to display an image by controlling pixels arranged in a matrix have been widely used. Examples of the display devices include a liquid crystal display device (LCD) and an organic light emitting diode device (OLED). Such display devices have a display panel having pixels arranged in a matrix, a gate driver for scanning pixels line by line, and a data driver for supplying an image data.

Recently, a display device having a gate driver and/or a data driver embedded on a display panel has been actively developed to simplify the fabricating process, reduce the weight and size of the panel, and reduce manufacturing cost. When manufacturing the display panel, the gate diver and/or the data driver are/is manufactured simultaneously. A plurality of thin film transistors (TFTs) are provided to control each of the pixels in the display panel, and the gate driver and/or the data driver can be manufactured through the same semiconductor process as the TFT.

Each of the gate drivers includes a plurality of shift registers for outputting output signals. For example, when the display panel has ten gate lines, ten shift registers are provided to supply their output signals to the ten gate lines, respectively.

FIG. 1 is a block diagram of a related art gate driver. As shown in FIG. 1, the related art gate driver includes a plurality of shift registers SRC1 through SRC[N+1] connected in a cascade manner. An output terminal OUT of each shift register is connected to a set terminal SET of the next shift register. The shift registers include n number of shift registers SRC1 through SRC[N] corresponding to n number of gate lines, and a dummy shift register SRC[N+1] for resetting the last shift register SRC[N].

The first shift register SRC1 is set by a pulse start signal STV. The pulse start signal is a pulse synchronized with a vertical synch signal Vsync. Each of the shift registers SRC2 through SRC[N+1] is set by an output signal of its previous shift register. When there are n number of the gate lines, output signals GOUT1 through GOUT[N] of the shift registers are connected to the corresponding gate lines, and an output signal GOUT[N+1] of the dummy shift register SRC [N+1] is not connected to any gate line.

A first clock CKV is supplied to the odd-numbered shift registers SRC1, SRC3, and so on, and a second clock CKVB is supplied to the even-numbered shift registers SRC2, SRC4, and so on. A phase of the first clock CKV is opposite to that of the second clock CKVB. The first clock CKV is simultaneously applied to the odd-numbered shift registers SRC1, SRC3, and so on, and the second clock CKVB is simultaneously applied to the even-numbered shift registers SRC2, SRC4, and so on.

The pulse start signal STV is applied to the first shift register SRC1 when the second clock CKVB is high. And, the shift registers SRC1 through SRC[N] output the respective output signals GOUT1 through GOUT[N] in synchronization with the first clock CKV or the second clock CKVB. Each of the shift registers SRC1 through SRC[N] is reset by the output signal of its next shift register.

Accordingly, each of the shift registers SRC1 through SRC [N] is set by the output signal of its previous shift register, outputs the output signal in synchronization with the first or second clocks CKV or CKVB, and then is reset by the output signal of its next shift register. However, since there is no shift register next to the dummy shift register SRC[N+1], the dummy shift register SRC[N+1] is reset by its own output signal GOUT[N+1].

FIG. 2 is a circuit diagram of a first shift register SRC1 illustrated in FIG. 1. FIG. 3 is a waveform diagram of driving signals applied to the first shift register of FIG. 2. Since all the shift registers illustrated in FIG. 1 have the identical structure to one another, only the first shift register SRC1 will be described for convenience.

When the pulse start signal STV is high, the first clock CKV and the second clock CKVB are low and high, respectively. Also, the first clock CKV and the second clock CKVB have a high state in clock unit. As shown in FIGS. 2 and 3, the first shift register SRC1 is set by the pulse start signal STV of a high state during a second clock (CKVB) period (i.e., when the second clock CKVB is high). That is, when the pulse start signal STV is applied, a Q node is charged to a voltage of the pulse start signal STV. A first transistor M1 is turned on by the charged Q node. Then, a QB node is discharged by a voltage difference (VDD-VSS) between a first power supply voltage and a second power supply voltage. Consequently, a low voltage of the QB node is maintained by a ratio of a resistance R1 of a first transistor M1 to a resistance R6 of a sixth transistor M6.

During a first clock (CKV) period (i.e., when the first clock signal CKV is high), a first output signal GOUT1 is output in response to the first clock CKV. When the first clock CKV is applied to the second transistor M2, a bootstrapping is caused by a drain-gate capacitance Cgd in a second transistor M2, and thus the Q node is charged with a voltage higher than that of the charged pulse start signal STV. Accordingly, the second transistor M2 is turned on and thus the first clock CKV is output as the first output signal GOUT1.

During the subsequent second clock (CKVB) period, the first shift register SRC1 is reset by the second output signal GOUT2 of its next shift register SRC2. That is, when a fifth transistor M5 is turned on by the second output signal GOUT2 of the shift register SRC2, the Q node is discharged by a first power supply voltage VSS passing through the fifth transistor M5. Additionally, the first transistor M1 is turned off by the discharged Q node, and the QB node is charged with the second supply voltage VDD passing through the sixth transistor M6, so that third and fourth transistors M3 and M4 are turned on by the charged QB node. Accordingly, the Q node is easily discharged by the first supply the voltage VSS passing through the turned-on fourth transistor M4. In this case, most of the output signal GOUT1 is discharged through a source-drain path of the second transistor M2, and the remaining output signal GOUT1 is discharged through the first power supply voltage VSS by the turned-on third transistor M3.

Since the other shift registers SRC2 through SRC[N] operate in the same way as the first shift register SRC1, the output signals GOUT1 through GOUT[N] having a high state are output sequentially. Accordingly, the output signals GOUT1 through GOUT[N] having a high state are sequentially output during one frame period by the shift registers SRC1 through SRC[N]. Then, these processes are repeated frame period by frame period.

During one frame period (16.67 ms), a high-state voltage is output for a very short time (20 μs) and a low-state voltage is output for the remaining time (90% or more) from each of the shift registers SRC1 through SRC[N]. In this case, a high-state voltage is maintained at the QB node connected to the gate of the third transistor M3 while the low-state voltage is output.

Consequently, the high-state voltage is maintained at the QB node for most of the frame period. Therefore, when the above operation is repeated for each frame period, a stress voltage is accumulated in the third transistor M3 connected to the QB node, thereby degrading the third transistor. For example, the stress voltage is accumulated over the frame periods as illustrated in FIG. 4.

Generally, an LCD is used as a display device and expected to operate for a number of years. In this case, the continuously cumulative stress voltage greatly degrades the threshold voltage and carrier mobility of the third transistor M3. Consequently, the third transistor M3 suffers in performance, making it difficult to accurately control the operation of the third transistor M3. Accordingly, an image is abnormally displayed on the LCD screen. Moreover, the performance degradation of the third transistor M3 also reduces the lifetime of the LCD.

SUMMARY OF THE INVENTION

Accordingly, the present invention is directed to a gate driver and a method of driving the same that substantially obviate one or more problems due to limitations and disadvantages of the related art.

An object of the present invention is to provide a gate driver to drive a liquid crystal display (LCD), such that the cumulative stress voltage is reduced to prevent damages to the LCD and a method of driving the gate driver.

Additional features and advantages of the invention will be set forth in part in the description which follows, and in part will become apparent from the description, or may be learned from practice of the invention. The objectives and other advantages of the invention will be realized and attained by the structure particularly pointed out in the written description and claims hereof as well as the appended drawings.

To achieve these objects and other advantages and in accordance with the purpose of the invention, as embodied and broadly described herein, a gate driver for a display device includes a plurality of shift registers to sequentially generate output signals during a frame period in response to multi-phase clocks; and a dummy clock provided to the plurality of shift registers during a vertical blank time to reduce a stress voltage in the shift registers, wherein an output of each of the shift registers is reset to a low state power supply voltage by an output signal of the next shift register.

In another aspect, method of driving a gate driver for a display device having a plurality of shift registers includes applying multi-phase clocks to the plurality of shift registers to sequentially generate output signals during a single frame period; and applying a dummy clock to the shift resisters to reduce a stress voltage in the shift registers during a vertical blank time.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

The present invention can be applied to 2-phase clocks, and also to multi-phase clocks such as 3-phase clocks, 4-phase clocks, and 5-phase clocks. For convenience, the following description will be made with respect to 2-phase clocks.

Figure 1:
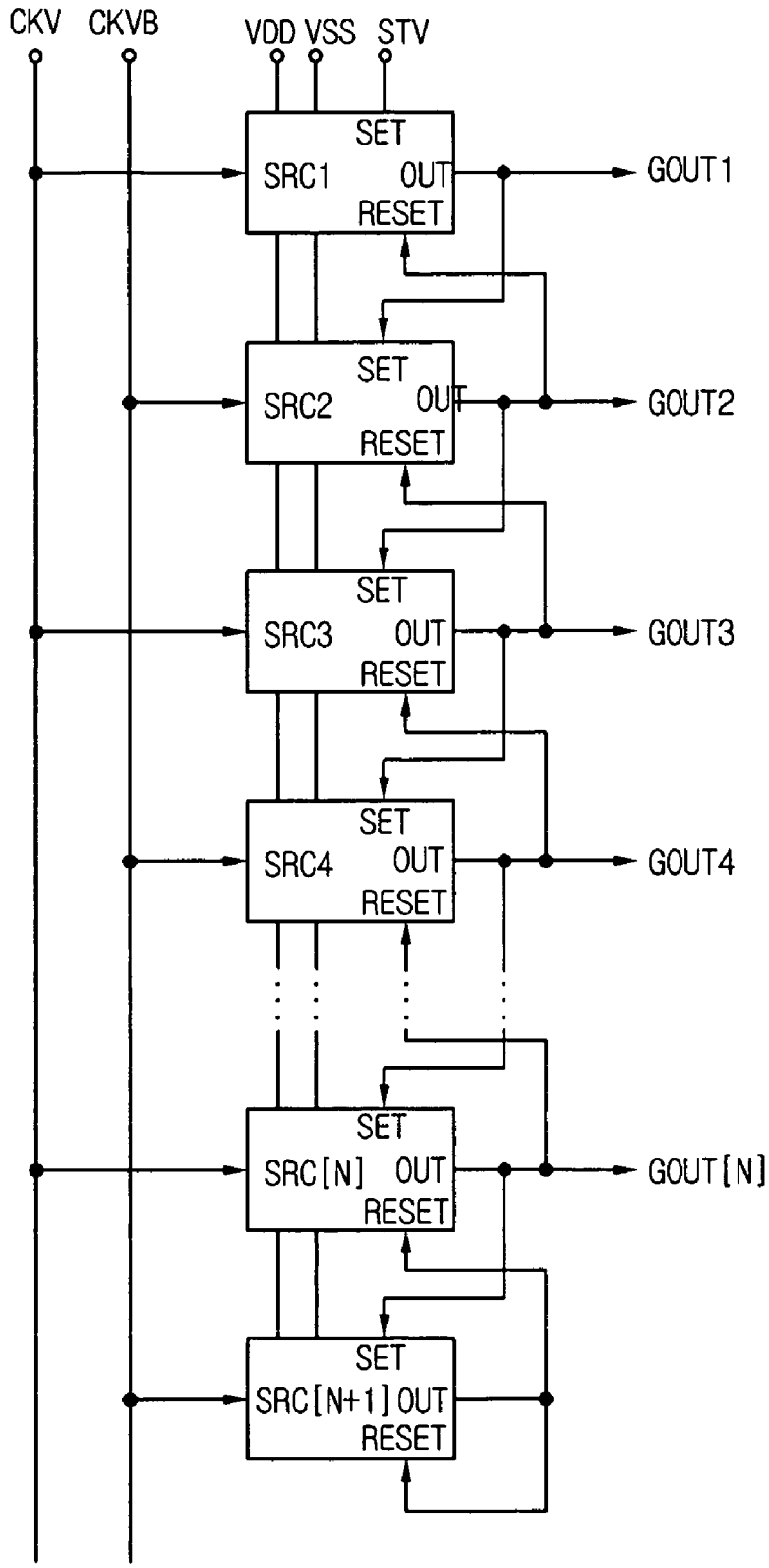
Fig.1 (Related Art)
FIG. 1 is a block diagram of a related art gate driver.
Figure 2:
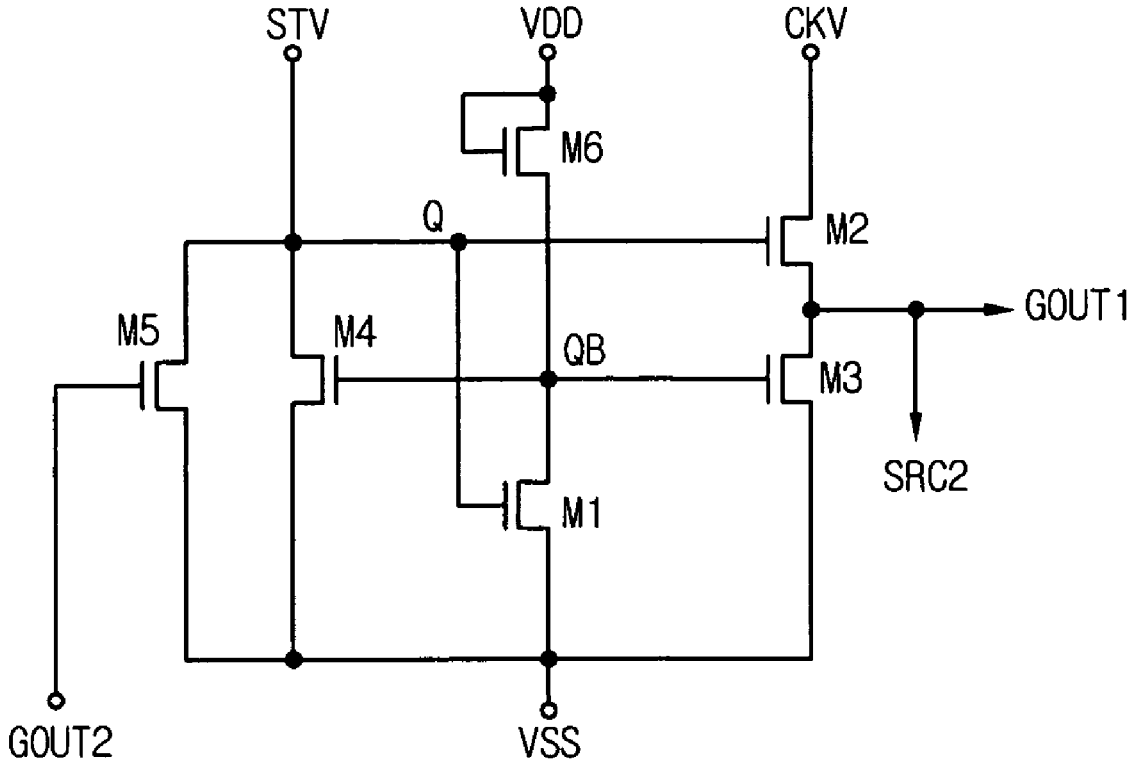
Fig.2 (Related Art)
FIG. 2 is a circuit diagram of a related art first shift register illustrated in FIG. 1.
Figure 3:
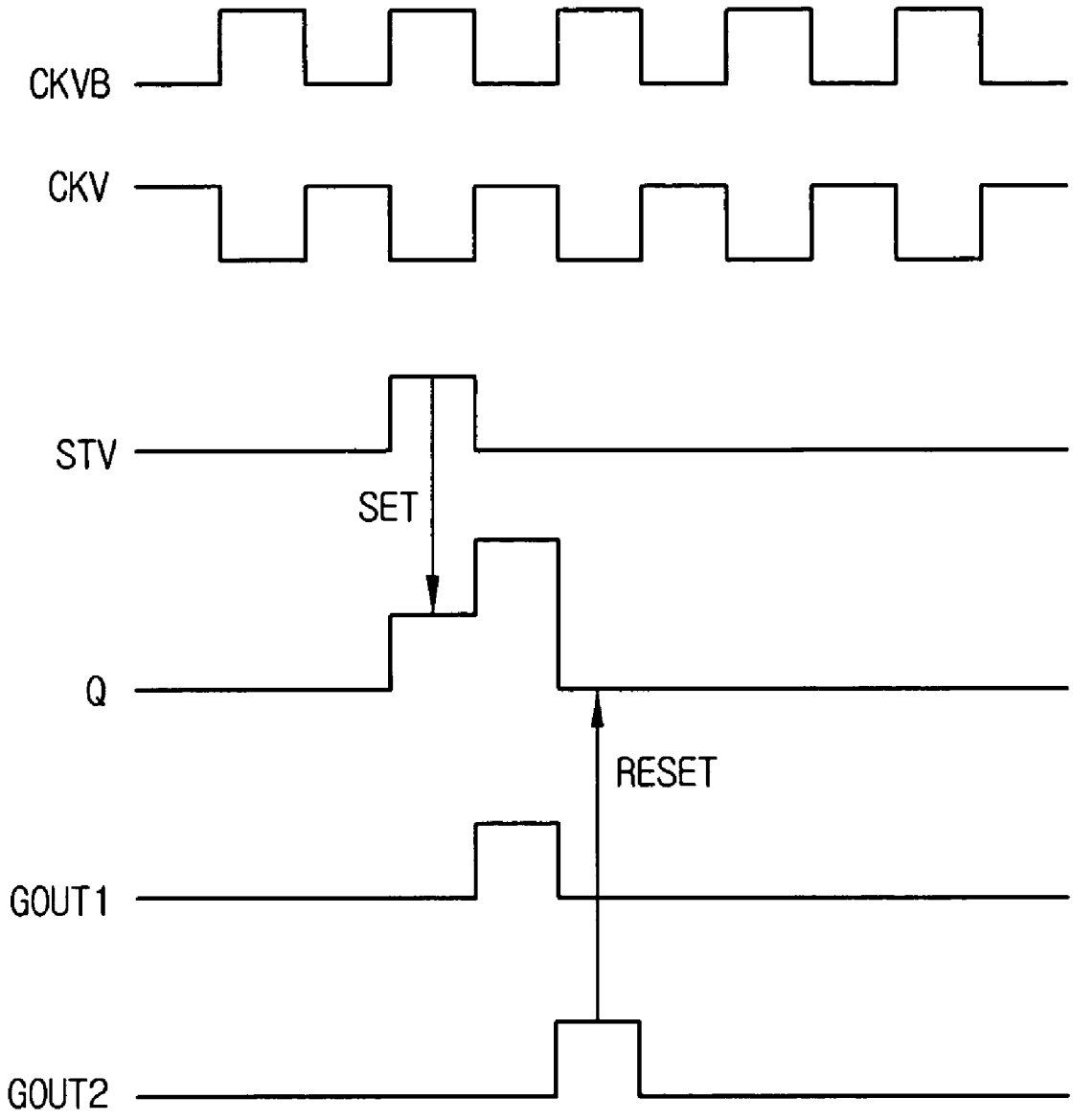
Fig.3 (Related Art)
FIG. 3 is a waveform diagram of driving signals applied to the first shift register of FIG. 2.
Figure 4:
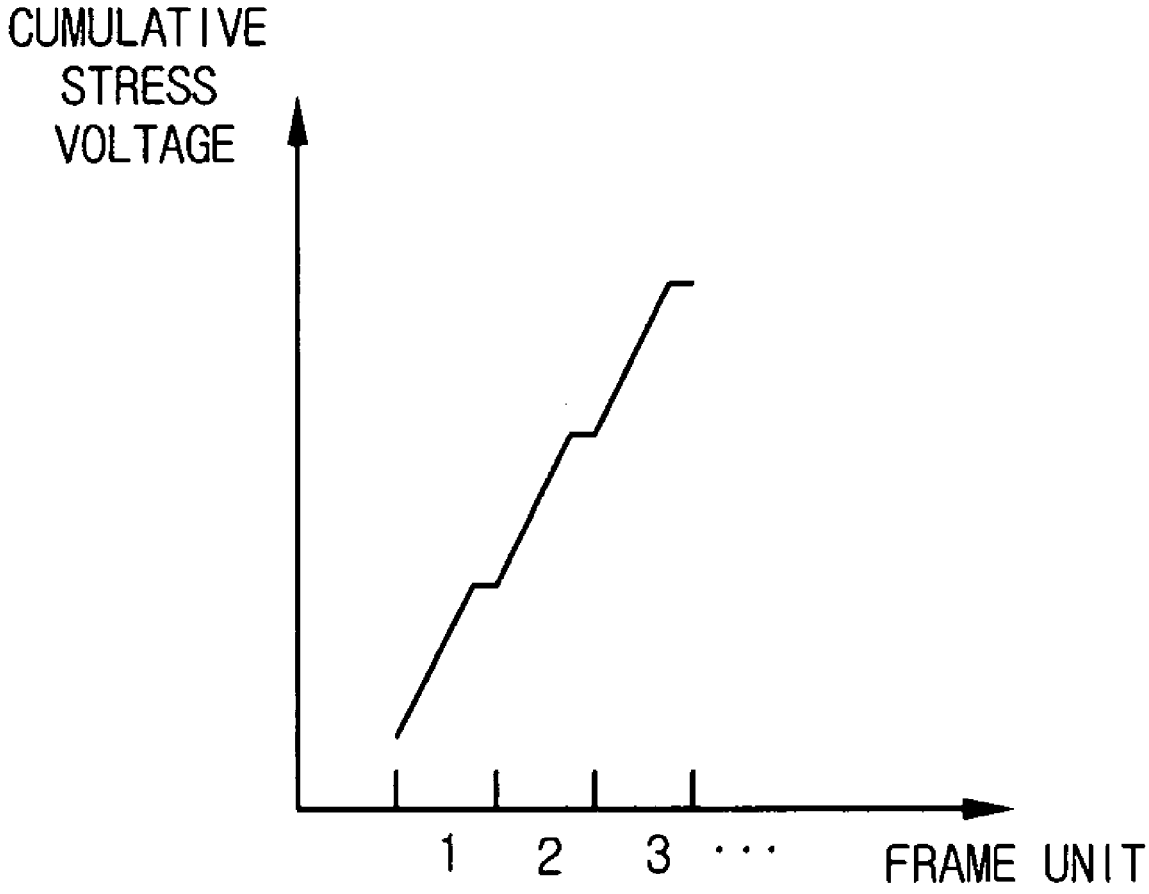
Fig.4 (Related Art)
FIG. 4 is a graph illustrating a cumulative stress voltage in the related art first shift register over the frame periods.
Figure 5:
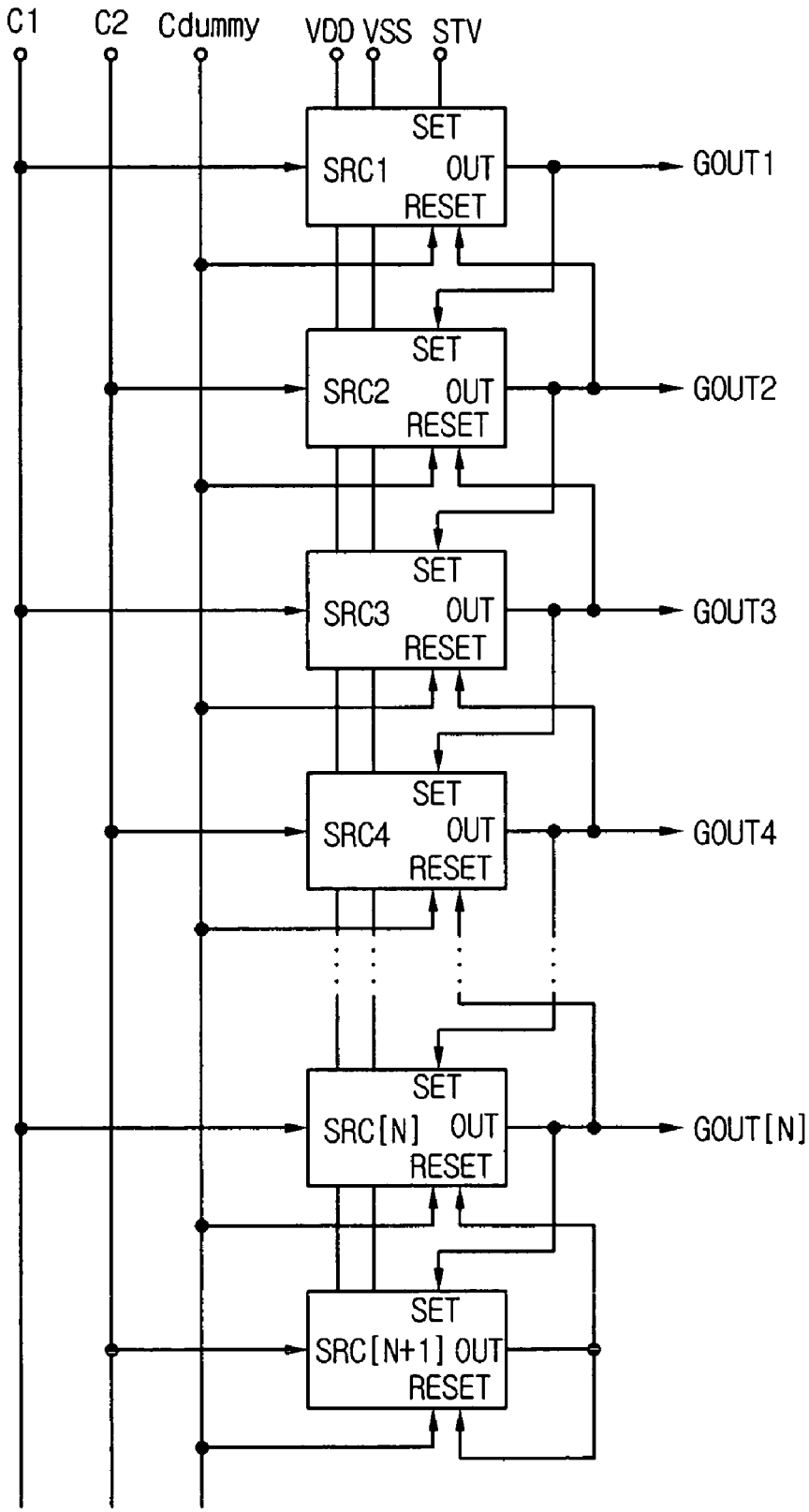
FIG. 5 is a block diagram of an exemplary gate driver according to a first exemplary embodiment of the present invention.
Figure 6:
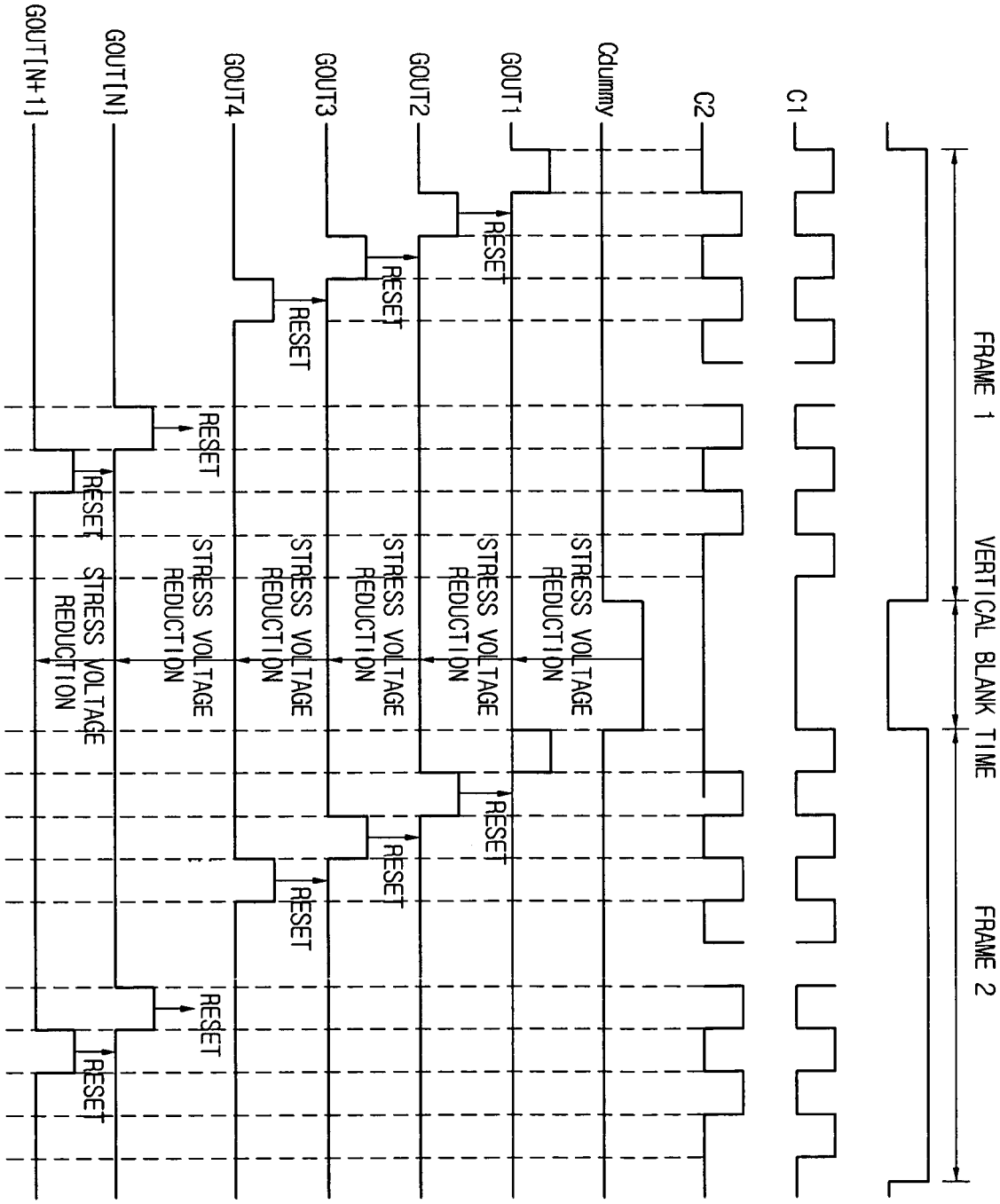
FIG. 6 is a waveform diagram of driving signals applied to the gate driver of FIG. 5.

FIG. 5 is a block diagram of an exemplary gate driver according to a first exemplary embodiment of the present invention. FIG. 6 is a waveform diagram of driving signals applied to the gate driver of FIG. 5.

As illustrated in FIG. 5, the gate driver includes n number of shift registers SRC1 through SRC[N] and a dummy shift register SRC[N+1]. The shift registers SRC1 through SRC [N] operate in response to one of 2-phase clocks including a first clock C1 and a second clock C2. That is, the first clock C1 is commonly connected to and simultaneously applied to the odd-numbered shift registers SRC1, SRC3, and so on. The second clock C2 is commonly connected to and simultaneously applied to the even-numbered shift registers SRC2, SRC4, and so on. Also, the shift resisters SRC1 through SRC[N+1] each operates in response to a dummy clock Cdummy. As shown in FIG. 6, the dummy clock Cdummy has a high-state pulse during a vertical blank time between frames. This high-state pulse is simultaneously applied to the shift registers SRC1 through SRC[N+1] to reduce stress voltages of the shift resisters SRC1 through SRC[N+1].

During the vertical blank time, the dummy clock Cdummy has a high-state pulse, but both the first and second clocks C1 and C2 are maintained at a low state. In this way, since the first and second clocks C1 and C2 have a low-state pulse during the vertical blank time, an undesired output signal is prevented from being output from the shift registers SRC1 through SRC[N]. The shift registers SRC1 through SRC[N] output the corresponding output signals GOUT1 through GOUT[N]. The output signal of each shift register is an input to a set terminal of the next shift register and is an input to a reset terminal of the previous shift register. For example, the output signal of the third shift register SRC3, GOUT3, is input into a set terminal of the fourth shift register SRC4 and a reset terminal of the second shift register SRC2. Accordingly, the next shift register is set and the previous shift register is reset by the output signal of the current shift register.

A first power supply voltage VSS and a second power supply voltage VDD are supplied to the shift registers SRC1 through SRC[N+1]. The first power supply voltage VSS has a low voltage level (i.e., −5V), and the second power supply voltage VDD has a high voltage level (i.e., 20V). When each shift register is set, a Q node connected to its output terminal OUT is charged with the second power supply voltage VDD. On the other hand, when the shift register is reset, the Q node is discharged to the first power supply voltage VSS.

An operation of the above gate driver will be described in detail with references to FIGS. 5 and 6. As shown in FIGS. 5 and 6, during a first frame period, the first shift register SRC1 is set by a pulse start signal STV and outputs a first output signal GOUT1 in response to the first clock C1.

The second shift register SRC2 is set by the first output signal GOUT1 and outputs a second output signal GOUT2 in response to the second clock C2. The second output signal GOUT2 is input into appropriate terminals of the first and third shift registers SRC1 and SRC3. Accordingly, the first shift register SRC1 is reset by the second output signal GOUT2. By repeating the above described operations, output signals GOUT1 through GOUT[N] are sequentially output from the shift registers SRC1 through SRC[N] respectively, during the first frame period.

In the subsequent vertical blank time following the first frame period, the first and second clocks C1 and C2 provide the low-state pulse, and the dummy clock provides the high-state pulse. At this time, the width of the high-state pulse is identical to or smaller than the vertical blank time. The dummy clock is applied to all shift registers SRC1 through SRC[N+1], thereby reducing the stress voltages accumulated in each of the shift registers SRC1 through SRC[N+1].

Figure 10:
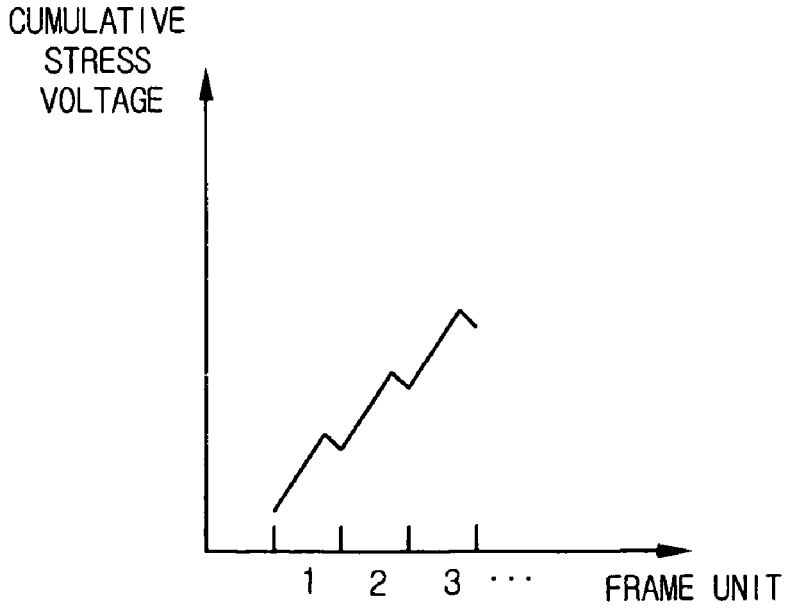
FIG. 10 is a graph illustrating a cumulative stress voltage that is reduced in the exemplary shift register according to the present invention.

Similarly, the output signals GOUT1 through GOUT[N] are sequentially output from the shift registers SRC1 through SRC[N], respectively, during a second frame period. Thus, the stress voltages of the each shift registers SRC1 through SRC[N+1] can be reduced during the vertical blank time between the frames by repeating the above described operations frame period by frame period. As shown in FIG. 10, the stress voltage accumulates during the first frame period, decreases some during a first vertical blank time, then accumulates during the second frame period, and decreases some during a second vertical blank time. Since the rate of the stress voltage accumulation over the frame periods can be lowered by implementing the exemplary shift register of the first exemplary embodiment of the present invention, damages to a transistor in each shift register can be prevented. Thus, it prevents the overall malfunction of the liquid crystal display and extends the life of the liquid crystal display.

Figure 7:
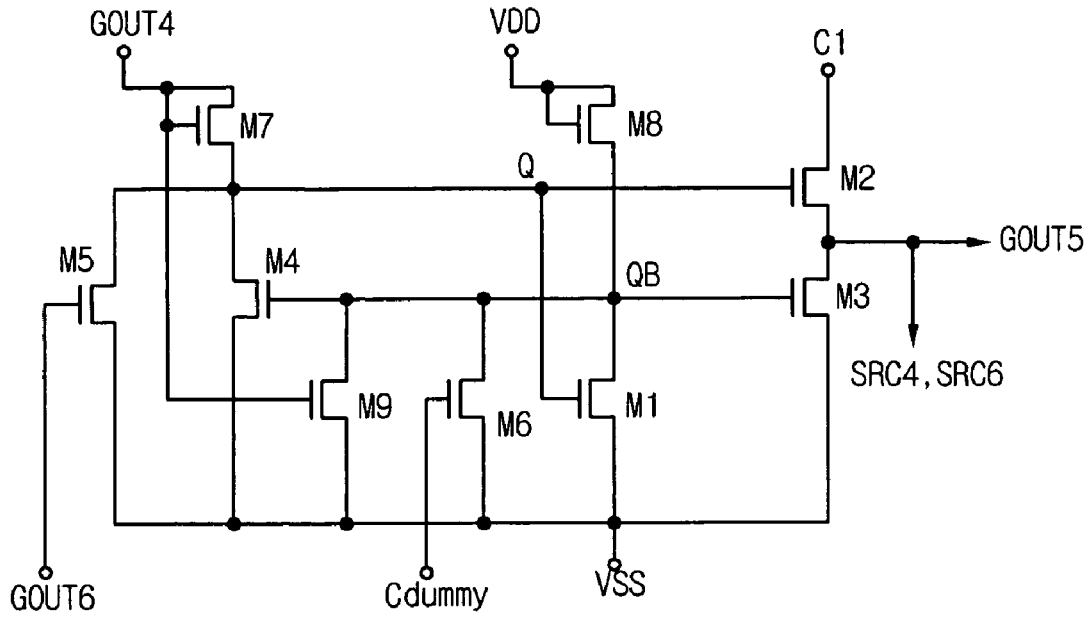
FIG. 7 is a circuit diagram of an exemplary shift register in FIG. 5 according to the first exemplary embodiment of the present embodiment.

FIG. 7 is a circuit diagram of the shift register in FIG. 5 according to the first exemplary embodiment of the present embodiment. As described earlier, the exemplary shift resisters of the present invention include gate drivers of all shift registers having the same structure. For convenience, single shift register (i.e., fifth shift register SRC5) is exemplarily illustrated in FIG. 7.

As shown in FIG. 7, the fifth shift register SRC5 includes second and third transistors M2 and M3 for controlling a fifth output signal GOUT5. The second transistor M2 includes a gate connected to a Q node, a drain connected to the first clock C1, and a source connected to the fifth output signal GOUT5. The third transistor M3 includes a gate connected to a QB node, a drain connected to a fifth output signal GOUT5, and a source connected to the first power supply voltage VSS. Accordingly, the second transistor M2 is switched on/off by the charge/discharge of the Q node, and the third transistor M3 is switched on/off by the charge/discharge of the QB node.

The Q node is charged by a fourth output signal GOUT4 of the fourth shift register SRC4. In addition, the Q node is discharged to the first power supply voltage VSS when the fifth transistor M5 is turned on by the output signal GOUT6 of the sixth shift register SRC6. Alternatively, when the QB node is charged with the second power supply voltage VDD, the fourth transistor M4 is turned on by the charged QB node, and the Q node is discharged to the first power supply voltage VSS through the fourth transistor M4. The fifth transistor M5 includes a gate connected to an output signal GOUT6, a drain connected to the Q node, and a source connected to the first power supply voltage VSS. The fourth transistor M4 includes a gate connected to the QB node, a drain connected to the Q node, and a source connected to the first power supply voltage VSS.

The QB node is charged by the second power supply voltage VDD, and is discharged to the first power supply voltage VSS through the first transistor M1. The first transistor M1 is switched on by the Q node. The first transistor M1 includes a gate connected to the Q node, a drain connected to the QB node, and a source connected to the first power supply voltage VSS. When the Q node is charged by the fourth output signal GOUT4, the first transistor M1 is turned on by the charged Q node, thereby discharging the QB node to the first power supply voltage VSS.

In addition, the QB node is also discharged to the first power supply voltage VSS through a ninth transistor M9. The ninth transistor M9 is switched on by the fourth output signal GOUT4. The ninth transistor M9 includes a gate connected to the fourth output signal GOUT4, a drain connected to the QB node, and a source connected to the first power supply voltage VSS.

Furthermore, the QB node is discharged to the first power supply voltage VSS through the sixth transistor M6. The sixth transistor M6 is switched on by the dummy clock Cdummy. The dummy clock Cdummy has a high-state pulse and is supplied to the appropriate transistor (i.e., M6) in each shift register during the vertical blank time.

In general, when the QB node is charged with the second power supply voltage VDD during the single frame period, the cumulative stress voltage of the third transistor M3 connected to the QB node increases. And, the cumulative stress voltage of the third transistor M3 accumulates frame period by frame period. The accumulation of the cumulative stress voltage results in the damages to the liquid crystal display and causes various problems.

According to the exemplary embodiments of the present invention, the sixth transistor M6 is turned on by the dummy clock Cdummy during the vertical blank time between the frame periods. Thus, the QB node is discharged to the first power supply voltage VSS, thereby minimizing the cumulative stress voltage of the third transistor M3 to prevent damages to the liquid crystal display.

The remaining exemplary shift registers have the same transistor structure as described with respect to the firth shift register SRC5. And, the exemplary shift registers as a whole, minimize the cumulative stress voltage of the shift registers SRC1 through SRC[N+1]. Accordingly, it is possible to prevent the malfunction of the liquid crystal display, extend the lifetime of the liquid crystal display, and enhance the product reliability.

A seventh transistor M7 including a gate and a drain commonly connected to the fourth output signal GOUT4 and a source connected to the Q node, may be further provided to prevent a reverse current flowing from the Q node to the fourth output signal GOUT4. Moreover, an eighth transistor M8, which includes a gate and a drain commonly connected to the second power supply voltage VDD and a source connected to the QB node, may be further provided to prevent a reverse current flowing from the QB node to the second power supply voltage VDD.

Figure 8:
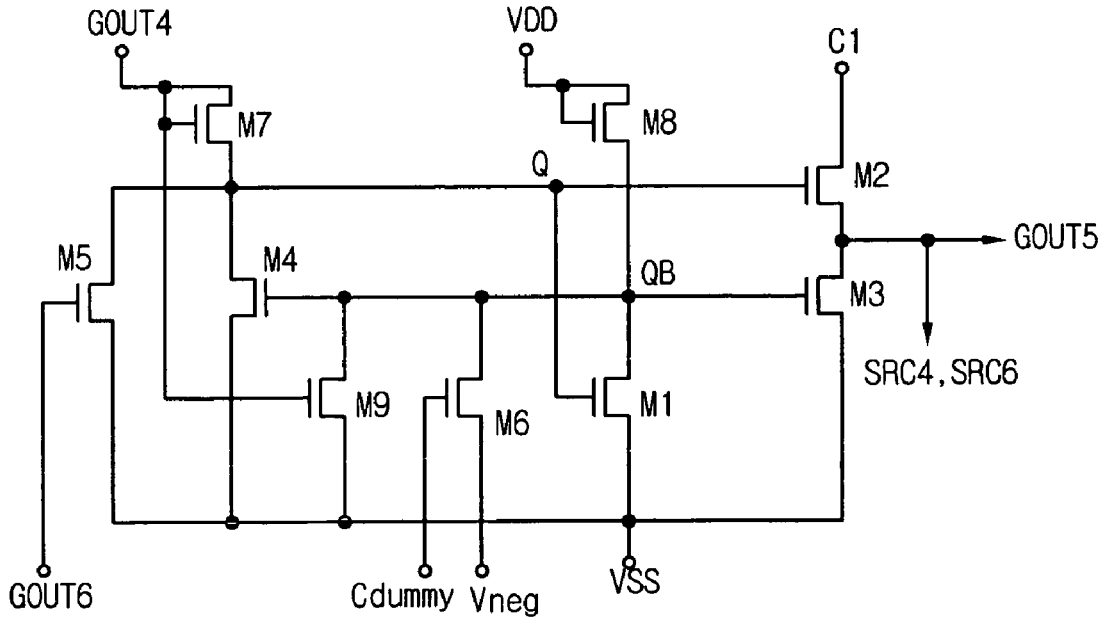
FIG. 8 is a circuit diagram of a exemplary shift register in FIG. 5 according to a second exemplary embodiment of the present embodiment.

FIG. 8 is a circuit diagram of an exemplary shift register in FIG. 5 according to a second exemplary embodiment of the present embodiment. As shown in FIG. 8, the shift register of FIG. 8 is substantially similar to the shift register of FIG. 7 with the exception that its QB node is discharged to a third power supply voltage Vneg. Vneg is at the level, e.g. about −30V, lower than the first power supply voltage VSS. Thus, when the sixth transistor M6 is turned on by the dummy clock during the vertical blank time, the QB node is discharged by the third power supply voltage Vneg lower than the first power supply voltage VSS.

Since the QB node is discharged to a lower voltage by the third power supply voltage Vneg that is even lower than the first power supply voltage VSS, the cumulative stress voltage can be further reduced to minimize malfunction of the liquid crystal display and damages to the liquid crystal display.

The gate driver operation according to the 2-phase clocks has been described above. However the exemplary embodiments of the present invention are not limited to the 2-phase clocks. The multi-phase clocks (e.g., 3-phase clocks, 4-phase clocks, and 5-phase clocks) can be also applied to the gate driver. Furthermore, the multi-phase clocks may be generated in synchronization with a horizontal period. For example, in the 2-phase clocks, a first clock has a high-state pulse in synchronization with a first horizontal period, and a second clock has a high-state pulse in synchronization with the next horizontal period. In this manner, the first and second clocks alternates the high-state pulse.

Figure 9:
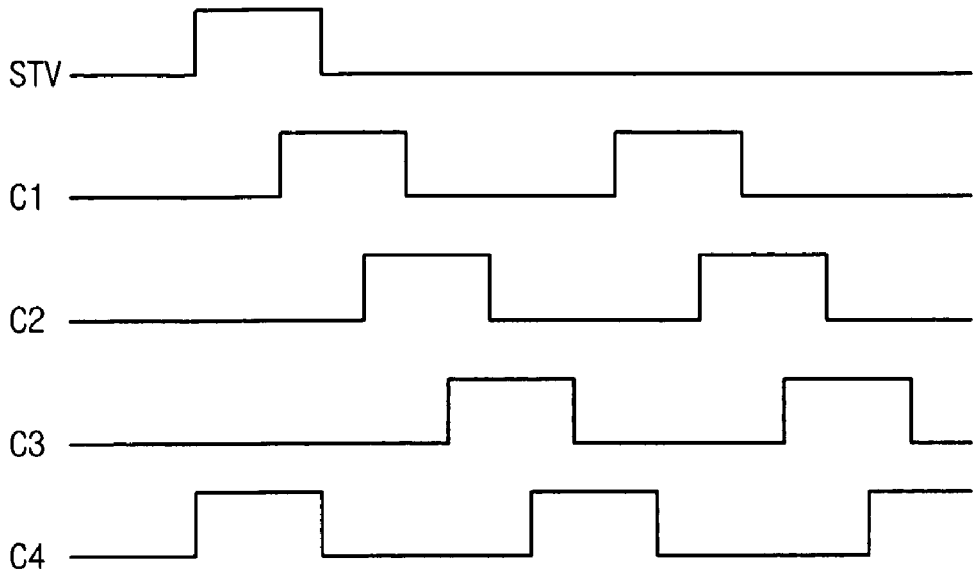
FIG. 9 is a waveform diagram illustrating 4-phase clocks having partially overlapping pulses according to an exemplary embodiments of the present invention.

In case of the 3-phase clocks, respective clocks may be generated such that their high-state pulses partially overlap one another. In case of the 4-phase clocks illustrated in FIG. 9, portions of the first and second clocks overlap each other, portions of the second and third clocks overlap each other, and portions of the third and fourth clocks overlap each other. The overlapped area between the clocks may be adjusted by a designer. If the clocks overlap each other by the half of the clock period, the first and third clocks are synchronized with each other and the second and fourth clocks are synchronized with each other.

As described above, the dummy clock having a high-state pulse is applied to each shift register during the vertical blank time between the frame periods, thereby discharging the QB node of each shift register. Accordingly, the cumulative stress voltage of the transistor connected to the QB node is minimized. As a result, the malfunction of the liquid crystal display can be prevented and the lifetime of the liquid crystal display can be extended, thereby enhancing the product reliability.

It will be apparent to those skilled in the art that various modifications and variations can be made in the gate driver and method of driving the same of the present invention without departing from the spirit or scope of the invention. Thus, it is intended that the present invention cover the modifications and variations of this invention provided they come within the scope of the appended claims and their equivalents.

What is claimed is:

1. A gate driver for a display device, comprising:

a plurality of shift registers to sequentially generate output signals during a frame period in response to multi-phase clocks; and a dummy clock provided to the plurality of shift registers during a vertical blank time to reduce a stress voltage in the shift registers, wherein the dummy clock is simultaneously applied to all shift registers during the vertical blank time.

2. The gate driver according to claim 1, wherein the multi-phase clocks include two-phase clocks generated in synchronization with horizontal periods.

3. The gate driver according to claim 1, wherein the multi-phase clocks further includes clocks having three or more phases and having pulses that partially overlap with one another.

4. The gate driver according to claim 1, wherein each of the shift registers includes a first transistor that is switched on or off by the dummy clock.

5. The gate driver according to claim 4, wherein each of the shift registers includes a second transistor having a gate connected to the first transistor, and the stress voltage in the second transistor is reduced by applying a low state power supply voltage to the gate of the second transistor by turning on the first transistor with the dummy clock.

6. The gate driver according to claim 4, wherein each of the shift registers includes a second transistor having a gate connected to the first transistor, and the stress voltage in the second transistor is reduced by applying a voltage level lower than a low state power supply voltage by turning on the first transistor with the dummy clock.

7. The gate driver according to claim 1, wherein the dummy clock has a high-state pulse during the vertical blank time.

8. The gate driver according to claim 7, wherein the width of the high-state pulse is identical to the vertical blank time.

9. The gate driver according to claim 7, wherein the width of the high-state pulse is smaller than the vertical blank time.

10. The gate driver according to claim 1, wherein an output of each of the shift registers is reset to a low state power supply voltage by an output signal of the next shift register.

11. A method of driving a gate driver for a display device including a plurality of shift registers, the method comprising:

applying multi-phase clocks to the plurality of shift registers to sequentially generate output signals during a single frame period; and applying a dummy clock to the shift resisters to reduce a stress voltage in the shift registers during a vertical blank time, wherein the dummy clock is simultaneously applied to all shift registers during the vertical blank time.

12. The method according to claim 11, further comprising:

resetting an output of each of the shift registers to a low state power supply voltage by applying an output signal of the next shift register.

13. The method according to claim 11, wherein the stress voltage is reduced by a low state power supply voltage.

14. The method according to claim 11, wherein the stress voltage is reduced by a voltage level lower than the low state power supply voltage.

15. The method according to claim 11, wherein the dummy clock has a high-state pulse during the vertical blank time.

16. The method according to claim 15, wherein the width of the high-state pulse is identical to the vertical blank time.

17. The method according to claim 15, wherein the width of the high-state pulse is smaller than the vertical blank time.

* * * * *